United States Patent [19]

Grzybowski

[11] Patent Number: 4,901,196

[45] Date of Patent: Feb. 13, 1990

[54] PORTABLE BARBEQUE LIGHTER

[76] Inventor: John D. Grzybowski, 2309 Bellfield Ave., Cleveland Heights, Ohio 44106

[21] Appl. No.: 194,277

[22] Filed: May 16, 1988

[51] Int. Cl.[4] ..... F23Q 7/00

[52] U.S. Cl. ..... 361/266; 219/237; 219/267; 219/270

[58] Field of Search ..... 361/264, 266; 219/221, 219/227, 229, 236, 237, 242, 260, 267, 268, 270, 481, 520, 531, 533, 534, 542, 544, 546

[56] References Cited

U.S. PATENT DOCUMENTS

| | | | |
|---|---|---|---|
| 908,238 | 12/1908 | Ganser | 361/266 |
| 2,404,841 | 7/1946 | Hess et al. | 361/266 |
| 2,938,988 | 5/1960 | McCutcheon et al. | 361/264 |
| 4,200,077 | 4/1980 | Kauhl et al. | 361/266 |

*Primary Examiner*—L. T. Hix
*Assistant Examiner*—David M. Gray
*Attorney, Agent, or Firm*—Renner, Otto, Boisselle & Sklar

[57] ABSTRACT

A battery operated barbeque igniter has an igniter implement with an axially extending heater element and a sheath to keep the heater element from accidentally burning anything or anyone as it cools after use. The heater element is positioned inside a metal tube which is closed at one end. The heater element includes a spiral tungsten filament supported between two coaxial quartz tubes. The outer quartz tube is closed at one end. A central steel rod extends the length of the metal tube and serves both to position the tungsten filament inside the metal tube and as an electric conductor to one end of the filament. The rod is brazed to the inner quartz tube and the filament at one end of the filament. The outer quartz tube is brazed to the inner quartz tube and the other end of the filament. The sheath receives the heater element and is slotted to permit cooling of the heater element without inadvertent contact with it.

6 Claims, 2 Drawing Sheets

PORTABLE BARBEQUE LIGHTER

FIELD OF THE INVENTION

The present invention relates to a fire igniter for a barbecue grill or the like, and especially to a portable fire igniter.

BACKGROUND OF THE INVENTION

Electric igniters for barbecue grills are well known. Typically they have a handle and a loop of electric resistance heater wire. In use the loop is buried under the charcoal or other material to be lit, and the unit is connected to household electric current until the charcoal starts to burn.

These units have several disadvantages. First, they cannot be used without a supply of electricity at 110 volts, and they draw perhaps ten amperes of current. Accordingly such devices cannot be used in remote locations such as parks or picnic areas. In addition, conventional igniters pose safety hazards after the fire or charcoal has been started. The heating element remains dangerously hot for some period of time even after it is unplugged. Because of its loop shape the heating element is difficult to cover. This makes it difficult to protect against accidental contact with the hot element.

Another type of electric resistance igniter has been used to ignite liquid or gaseous fuels. These igniters use an electric resistance wire wound around a ceramic core which is then at least partially encased in another ceramic tube. These units are not suitable for lighting barbecue grills because they rely on direct contact between the fuel and the ceramic casing for ignition. A barbecue grill is too hostile an environment for the brittle ceramic of these types of heaters to survive long.

SUMMARY OF THE INVENTION

The present invention provides a barbecue igniter which is portable, rugged, and uniquely shaped to be safety stored, as well as a method of making such an igniter. The igniter consists of a portable rechargeable battery, a cord, an igniter implement, and a sheath to protect the igniter implement when not in use. The igniter implement includes a handle from which extends a long cylindrical metal tube. Inside the metal tube at its free end is a heating element which includes a concentric pair of ceramic tubes with a tungsten wire wrapped around the inner tube and filling the space between the two tubes. The tubes and wire are proportioned to fit snugly within the metal casing with only a limited space between the tungsten spiral and inside of the outer ceramic tube and a minimum of space between the tungsten wire and the inner ceramic tube. In this way the tungsten wire is protected against excessive lateral movement.

The heater element is mounted on a central steel support rod which extends the length of the inner tube and extends over at least a substantial portion of the length of the metal tube. The inner ceramic tube may be brazed to the steel support rod to prevent movement with respect to the steel support rod, and one end of the tungsten filament is also connected to the steel support rod. The outer ceramic tube is brazed to the inner ceramic tube at the opposite end of the tungsten filament which is also embedded in the brazing. The steel plug thus formed makes a second electrical connection to which a wire is attached which runs the length of the metal tube. The metal tube may be partly filled with epoxy to position the steel support rod and thus the heating element in the remote or distal end of the metal tube.

Because of the elongate shape, the igniter implement may be readily stored in a sheath whenever it is not in use. The sheath consists of a metal sleeve into which the igniter implement's metal tube fits. The sleeve is surrounded by insulating material, and at the distal end of the sheath slots are cut which at least partially expose the metal tube. The slots permit the hottest portions of the implement to cool radiantly and convectively while still preventing accidental contact with the metal tube.

DESCRIPTION OF PREFERRED EMBODIMENT

Figure 1:
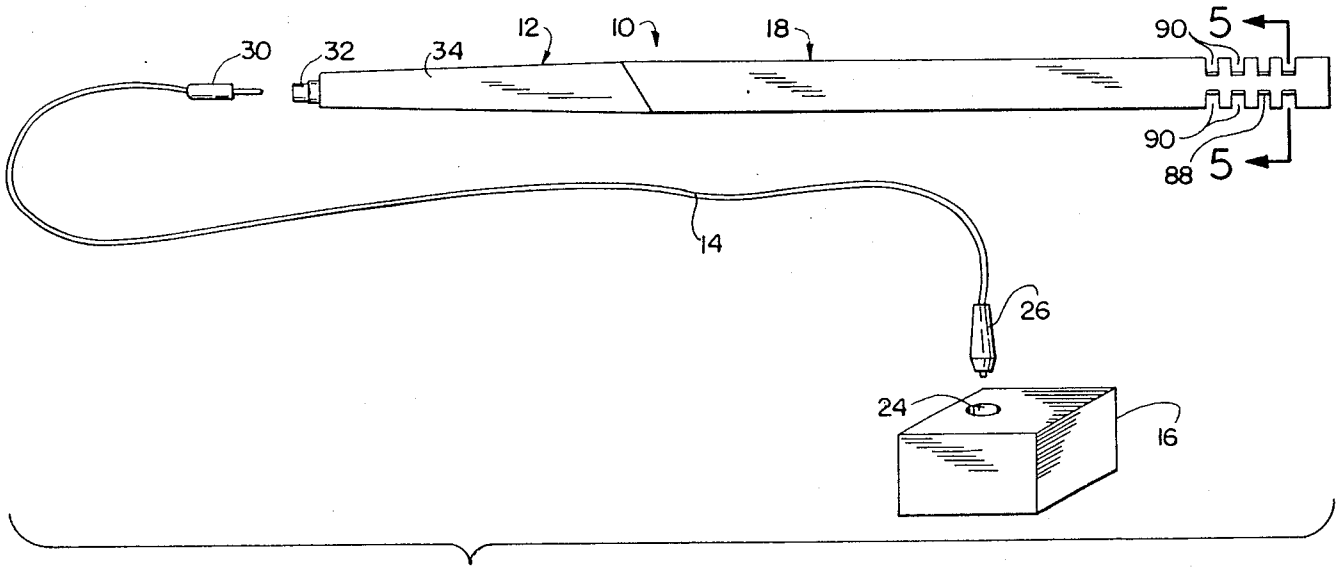
FIG. 1 illustrates a fire igniter constructed in accordance with the present invention.

The portable fire igniter 10 includes an igniter implement 12, a cord 14, a battery 16 and a sheath 18. The battery 16 is a rechargeable battery and is provided with a female socket 24 into which a male plug 26 may be inserted. Conveniently the socket and plug, 24 and 26, have the same size and configuration as a conventional cigarette lighter socket and plug in an automobile. This permits the portable fire igniter 10 to be used simply by plugging it into an automobile cigarette lighter.

At the end of the cord 14 opposite from the male plug 26 is a conventional jack 30 which may be inserted into a socket 32 formed in the handle 34 of the implement 12. By means of the battery 16 and cord 14 electric power is supplied to the igniter implement 12. The battery may be a lead acid battery for example, Power Sonic Model PS 1226, a 12 volt, 3.2 amp hr battery manufactured by Power Sonic Corporation of Redwood City, Calif. Of course other batteries such as nickel cadmium batteries could also be used.

Figure 2:
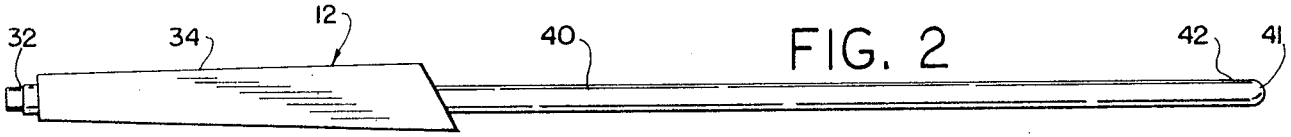
FIG. 2 illustrates an igniter implement forming a part of the fire igniter of FIG. 1.

The handle 34 (FIG. 2) of the igniter implement 12 is formed of an insulating material, for example wood. A metal tube 40 extends from the handle 34. The tube 40 is cylindrical and has a free or distal end portion 42. Preferably the tube is formed of 304 stainless steel. Although the tube 40 is shown as being cylindrical, it could have other cross sections. It is significant however that the tube 40 is elongate, generally straight, and has a free end. (An arcuate shape with a uniform radius of curvature is also a conceivable shape for the tube 40, but it could present minor assembly difficulties.) The tip 41 of the tube 40 is closed with a brazed steel plug. This protects the contents of the tube 40 from breakage through contact with foreign objects.

Figure 3:
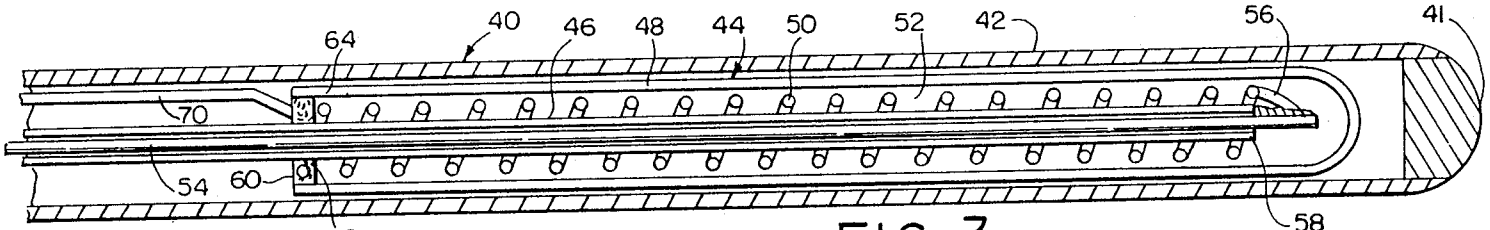
FIG. 3 is an enlarged cross sectional view through the implement of FIG. 2.
Figure 4:
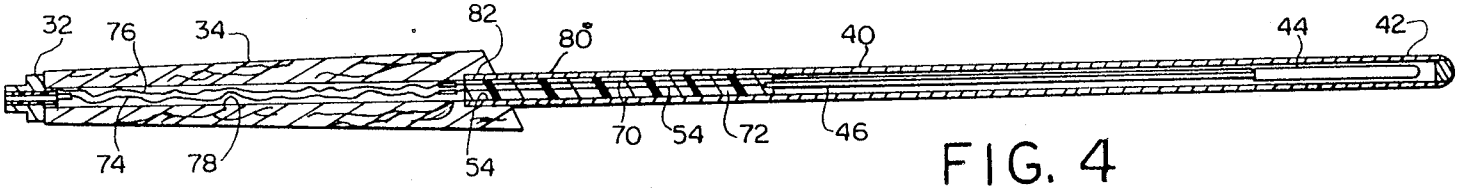
FIG. 4 is a cross sectional view through the implement of FIG. 2.

The free end portion 42 of the metal tube 40 contains a heater element 44 (FIGS. 3 and 4). The heater element 44 includes an inner quartz tube 46 (FIG. 3), an outer quartz tube 48 and a spirally wound tungsten filament 50. The spiral wound filament 50 is formed initially of annealed tungsten. The use of annealed tungsten permits the wire to be wound without fracture. The wire is preferably 0.25 mm. in diameter, and the total length is approximately 23 cm.

The tungsten filament 50 is wound around the inner quartz tube 46 and is positioned in the annular space 52 between the inner and outer quartz tubes, 46 and 48, respectively. The quartz tubes are proportioned so that the annular space 52 has an outside diameter approximately equal to the outside diameter of the spiral of tungsten filament 50 and an inside diameter approximately equal to the inside diameter of the spiral of tungsten filament 50. Therefore, when the tungsten filament is placed between the inner and outer quartz tubes, 46 and 48, it is supported against excessive lateral movement. This is important because tungsten, when it has been heated to temperatures as high as those achieved locally by the heater element 44 (in excess of 1600° C.) becomes very brittle. The positioning of the two quartz tubes thus serves to protect the tungsten filament from breakage.

The heater element 44 is held in position in the distal end portion 42 of the metal tube 40 by means of a steel support rod 54. The steel support rod substantially fills the internal bore through the inner quartz tube 46, so there is little lateral movement permitted. The steel support rod 54 also serves as an electrical conductor. The distal end 56 of the filament 50 is brazed to the steel rod 54. In this same brazing operation the distal end 58 of the inner quartz tube 46 is rigidly connected to the steel support rod 54. The brazing operation supplies molten steel which fuses with the inner quartz tube 46 as well as making a permanent connection with the distal end 56 of the filament 50.

The outer quartz tube 48 is closed at its distal end. This prevents accidental contact between the steel support rod 54 and the tip 41 of the metal tube 40. Such contact could cause an electrical short circuit. The outer quartz tube 48 extends from near the tip 41 of the metal tube 40 toward the handle 34 and is coextensive with the spiral filament 50. The proximal end portion 62 of the filament 50 and the proximal end portion 64 of the outer tube 48 are brazed to the inner quartz tube 46. The brazing performs a dual function: the brazing forms an electrical contact point for the proximal end 62 of the filament 50, and because the molten steel melts and partially bonds with the quartz of the inner and outer tubes 46 and 48, respectively, it provides a mechanical connection securing the tubes relative to each other. The brazing at the proximal end portions 62 and 64 of the filament 50 and outer tube 48 thus provides a steel plug with the functions noted above.

A wire 70 is also fused to the metal plug 66 during the brazing operation. The wire 70 together with the steel support rod 59 form the two electrical leads supplying power to the filament 50. The inner quartz tube 46 serves to insulate the steel rod 54 from the second conductor 70. The metal tube 40 is approximately 11 inches long with the heating element being disposed in the distal two inches or so. The inner quartz tube 46 extends approximately six inches in the proximal direction toward the handle 34, as shown in FIG. 4. During operation the temperature in this portion of the tube 40 is too great for conventional electric insulators to survive. The quartz tube 46 can withstand the heat. The tube 46 will prevent a short circuit even if it fractures, since the usual fracture mode leaves a large number of quartz rings around the steel rod 54.

The remainder of the metal tube 40 from the handle 34 to the proximal end of the inner quartz tube 46 does not get as hot during operation. This portion of the metal tube 40 is filled with epoxy 72. The inner quartz tube 46 is partially embedded in the epoxy while the steel support rod 54 and second conductor 70 extend to slightly beyond the proximal end 80 of the metal tube 40. The epoxy 72 serves to insulate electrically the wire 70 from the support rod 54 and to position the heater 44 axially in the tube 40.

Once the epoxy 72 has hardened, the steel support rod 54 and second conductor 70 are connected to wires 74 and 76, respectively, which extend through a bore 78 through the handle 34. The wires 74 and 76 are insulated and extend from the contacts on the socket 32 to the steel support rod and second conductor. Electrical connections may be made by soldering or by any conventional method. Once the electrical connections have been made, the proximal end 80 of the metal tube 40 is inserted into a counterbore 82 formed in the handle 34. A suitable adhesive may be used to hold it in place, or friction may be relied upon to hold it.

Because the metal tube 40 is essentially linear, it is possible to provide a sheath 18 (FIG. 1) which can protect against inadvertent contact with the metal tube 40 when it is not in use but still hot. The sheath 18 includes a metal sleeve 88 into which the tube 40 may be inserted. The sleeve 88 may conveniently be made of brass.

Figure 5:
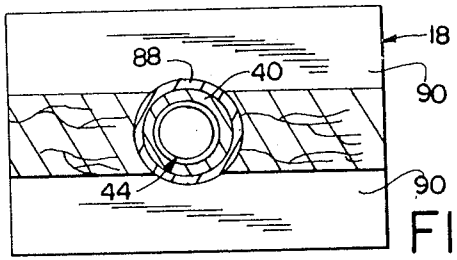
FIG. 5 is a view looking in the direction of arrows 5—5 of FIG. 1.

The sleeve 88 (FIG. 5) fits within a central bore through a suitable insulating material which forms the bulk of the sheath 18. In a preferred embodiment the sheath 18 is formed of wood as shown in FIG. 5. Sheath 18 includes passages 90 which are cut through the insulating material and which expose the sheath 88 at least where the sleeve 88 surrounds the distal end portion 42 of the tube 40. This is the region of the tube 40 which gets hottest, and the passages 90 permit direct radiation of heat from the surface of the sleeve 88 and also convective cooling.

Thus it is clear that the present invention provides a barbecue igniter 10 which is portable, rugged, and uniquely shaped to be safely stored as well as a method of making such an igniter. In use, the operator grips the handle 34 to withdraw the implement 12 from the sheath 18. The distal end 42 of the metal tube 40 is placed in contact with charcoal or other flammable material to be ignited, and the cord 14 is plugged into the battery 16 and implement's socket 32. The metal tube 40 then heats to about 1100° C. at the surface of the distal end portion 42. This temperature is hot enough to ignite charcoal or wood, but will only cause paper to smolder. Once the coals are burning the implement 12 is withdrawn from the fire and returned to the sheath 18 which protects against dangerous accidental direct contact with the hot metal tube 40.

What is claimed is:

1. A portable electric fire igniter comprising a battery and an igniter implement having a manually engageable handle, a metal tube extending from the handle and a heater element disposed within the tube, the tube having a free end portion remote from the handle, the heater element including inner and outer quartz tubes disposed within the free end portion of the metal tube and generally concentric therewith, the outer quartz tube being closely adjacent the inside of the metal tube and the two quartz tubes defining between themselves an annular, axially extending space, wherein one end of the outer quartz tube, remote from the handle, is closed and a steel plug is positioned between the inner and outer quartz tubes at the other end of the outer tube, one end portion of a tungsten filament being electrically connected to the steel plug, the tungsten filament disposed in the space between the two quartz tubes and said steel plug and the other end portion of the filament electrically connected with the battery, the filament being spirally wound around the inner quartz tube and supported against excessive transverse movement by the inner and outer quartz tubes.

2. The igniter of claim 1 wherein the steel plug is brazed in place.

3. The igniter of claim 1 including a steel support rod extending through the center of the inner quartz tube.

4. The igniter of claim 3 wherein one end of the tungsten filament is electrically connected to the steel support rod.

5. The igniter of claim 1 wherein the free end portion of the metal tube is closed.

6. The igniter of claim 4 wherein the metal tube is stainless steel.

* * * * *